US006169520B1

(12) United States Patent
Anderson

(10) Patent No.: US 6,169,520 B1
(45) Date of Patent: Jan. 2, 2001

(54) PLASMA ANTENNA WITH CURRENTS GENERATED BY OPPOSED PHOTON BEAMS

(75) Inventor: Theodore R. Anderson, West Greenwich, RI (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/285,175

(22) Filed: Mar. 23, 1999

(51) Int. Cl.[7] ..... H01Q 1/26
(52) U.S. Cl. ..... 343/701
(58) Field of Search ..... 343/701, 713, 343/720, 711; 315/111.21; H01Q 1/26

(56) References Cited

U.S. PATENT DOCUMENTS 3,914,766 * 10/1975 Moore ..... 343/701
4,792,732 * 12/1988 O'Loughlin ..... 315/334
5,594,456 * 1/1997 Norris et al. ..... 343/701
5,666,023 * 9/1997 Pelletier ..... 315/111.21

* cited by examiner

*Primary Examiner*—Don Wong
*Assistant Examiner*—Hoang Nguyen
(74) *Attorney, Agent, or Firm*—Michael J. McGowan; Robert W. Gauthier; Prithvi C. Lall

(57) ABSTRACT

A plasma antenna with a plasma column is provided. Lasers are disposed to transmit photon beams through the plasma in an alternating, oppositely directed fashion. When a laser is energized, its laser beam produces photon-electron collisions that impart momentum to electrons in the plasma. Alternating the operation of the lasers produces an alternating current in the plasma that radiates an electromagnetic field.

30 Claims, 7 Drawing Sheets

PLASMA ANTENNA WITH CURRENTS GENERATED BY OPPOSED PHOTON BEAMS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to communications antennas, and more particularly to plasma antennas adaptable for use in any of a wide range of frequencies.

(2) Description of the Prior Art

A specific antenna typically is designed to operate over a narrow band of frequencies. However, the underlying antenna configuration or design may be adapted or scaled for widely divergent frequencies. For example, a simple dipole antenna design may be scaled to operate at frequencies from the 3–4 MHz band up to the 100 MHz band and beyond.

At lower frequencies the options for antennas become fewer because the wavelengths become very long. Yet there is a significant interest in providing antennas for such lower frequencies including the Extremely Low Frequency (ELF) band, that is less than 3 kHz, the Very Low Frequency (VLF) band including signals from 20 kHz to 60 kHz and the Low Frequency (LF) band with frequencies in the 90 to 100 kHz band. However, conventional half-wave and quarter-wave antenna designs are difficult to implement because at 100 Hz, for example, a quarter-wave length is of the order of 750 km.

Notwithstanding these difficulties, antennas for such frequencies are important because they are useful in specific applications, such as effective communications with a submerged submarine. For such applications, conventional ELF antennas comprise extremely long, horizontal wires extended over large land areas. Such antennas are expensive to construct and practically impossible to relocate at will. An alternative experimental Vertical Electric Dipole (VEP) antenna uses a balloon to raise one end of a wire into the atmosphere to a height of up to 12 km or more. Such an antenna can be relocated. To be truly effective the antenna should extend along a straight line. Winds, however, can deflect both the balloon and wire to produce a catenary form that degrades antenna performance. Other efforts have been directed to the development of a corona mode antenna. This antenna utilizes the corona discharges of a long wire to radiate ELF signals.

Still other current communication methods for such submarine and other underwater environments include the use of mast mounted antennas, towed buoys and towed submersed arrays. While each of these methods has merits, each presents problems for use in an underwater environment. The mast of current underwater vehicles performs numerous sensing and optical functions. Mast mounted antenna systems occupy valuable space on the mast which could be used for other purposes. Consequently, as a practical matter, the use of such antennas for ELF or other low frequency communications is not possible because they require too much space. For both towed buoys and towed submersed arrays, speed must be decreased to operate the equipment.

Conventional plasma antennas are of interest for communications with underwater vessels since the frequency, pattern and magnitude of the radiated signals are proportional to the rate at which the ions and electrons are displaced. The displacement and hence the radiated signal can be controlled by a number of factors including plasma density, tube geometry, gas type, current distribution, applied magnetic field and applied current. This allows the antenna to be physically small, in comparison with traditional antennas. Studies have been performed for characterizing electromagnetic wave propagation in plasmas. Therefore, the basic concepts, albeit for significantly different applications, have been investigated.

With respect to plasma antennas, U.S. Pat. No. 1,309,031 to Hettinger discloses an aerial conductor for wireless signaling and other purposes. The antenna produces, by various means, a volume of ionized atmosphere along a long beam axis to render the surrounding atmosphere more conductive than the more remote portions of the atmosphere. A signal generating circuit produces an output through a discharge or equivalent process that is distributed over the conductor that the ionized beam defines and that radiates therefrom.

U.S. Pat. No. 3,404,403 to Vellase et al. uses a high power laser for producing the laser beam. Controls repeatedly pulse and focus the laser at different points thereby to ionize a column of air. Like the Hettinger patent, a signal is coupled onto the ionized beam.

U.S. Pat. No. 3,719,829 to Vaill discloses an antenna constructed with a laser source that establishes an ionized column. Improved ionization is provided by means of an auxiliary source that produces a high voltage field to increase the initial ionization to a high level to form a more highly conductive path over which useful amounts of electrical energy can be conducted for the transmission of intelligence or power. In the Hettinger, Vellase et al. and Vaill patents, the ionized columns merely form vertical conductive paths for a signal being transmitted onto the path for radiation from that path.

U.S. Pat. No. 3,914,766 to Moore discloses a pulsating plasma antenna, which has a cylindrical plasma column and a pair of field exciter members parallel to the column. The location and shape of the exciters, combined with the cylindrical configuration and natural resonant frequency of the plasma column, enhance the natural resonant frequency of the plasma column, enhance the energy transfer and stabilize the motion of the plasma so as to prevent unwanted oscillations and unwanted plasma waves from destroying the plasma confinement.

U.S. Pat. No. 5,594,456 to Norris et al. discloses an antenna device for transmitting a short pulse duration signal of predetermined radio frequency. The antenna device includes a gas filled tube, a voltage source for developing an electrically conductive path along a length of the tube which corresponds to a resonant wavelength multiple of the predetermined radio frequency and a signal transmission source coupled to the tube which supplies the radio frequency signal. The antenna transmits the short pulse duration signal in a manner that eliminates a trailing antenna resonance signal. However, as with the Moore antenna, the band of frequencies at which the antenna operates is limited since the tube length is a function of the radiated signal.

Notwithstanding the disclosures in the foregoing references, a number of applications, including ELF applications, still use conventional land-based antennas. There remains a requirement for an antenna that provides effectively the same radiation levels as conventional antennas, but that requires significantly less space. There additionally exists a requirement for such an antenna to provide the transmission of various frequencies, including ELF and other low-frequency signals.

SUMMARY OF THE INVENTION

Accordingly it is an object of the present invention to provide an antenna capable of operation with ELF and other signals.

Another object of this invention is to provide an antenna that is capable of transmitting signals in different frequency ranges including the ELF range.

Still another object of this invention is to provide an antenna that is transportable.

Yet another object of this invention is to provide an antenna that can be mounted in a restricted volume.

In accordance with this invention, an antenna for radiating an electromagnetic field at a predetermined frequency comprises an axially extending elongated container for a plasma. First and second photon generators direct first and second photon beams, respectively, along the axis through the plasma in opposite directions. The first and second photon generators are energized in an alternative fashion thereby to generate in the plasma an alternating current that produces the radiated electromagnetic field at the predetermined frequency.

In accordance with another aspect of this invention, an antenna for irradiating an electromagnetic field at a predetermined frequency comprises an axially extending elongated plasma container for an ionizable gaseous medium. First and second lasers located at each end of the plasma container direct first and second laser beams respectively along the axis through the gaseous medium in opposite directions. The first and second lasers are energized in an alternative fashion. Each time one of the lasers is energized it ionizes the gaseous medium to produce a plasma. Alternatively energizing the first and second lasers generates an alternating current in the plasma that produces the radiated electromagnetic field at the predetermined frequency.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
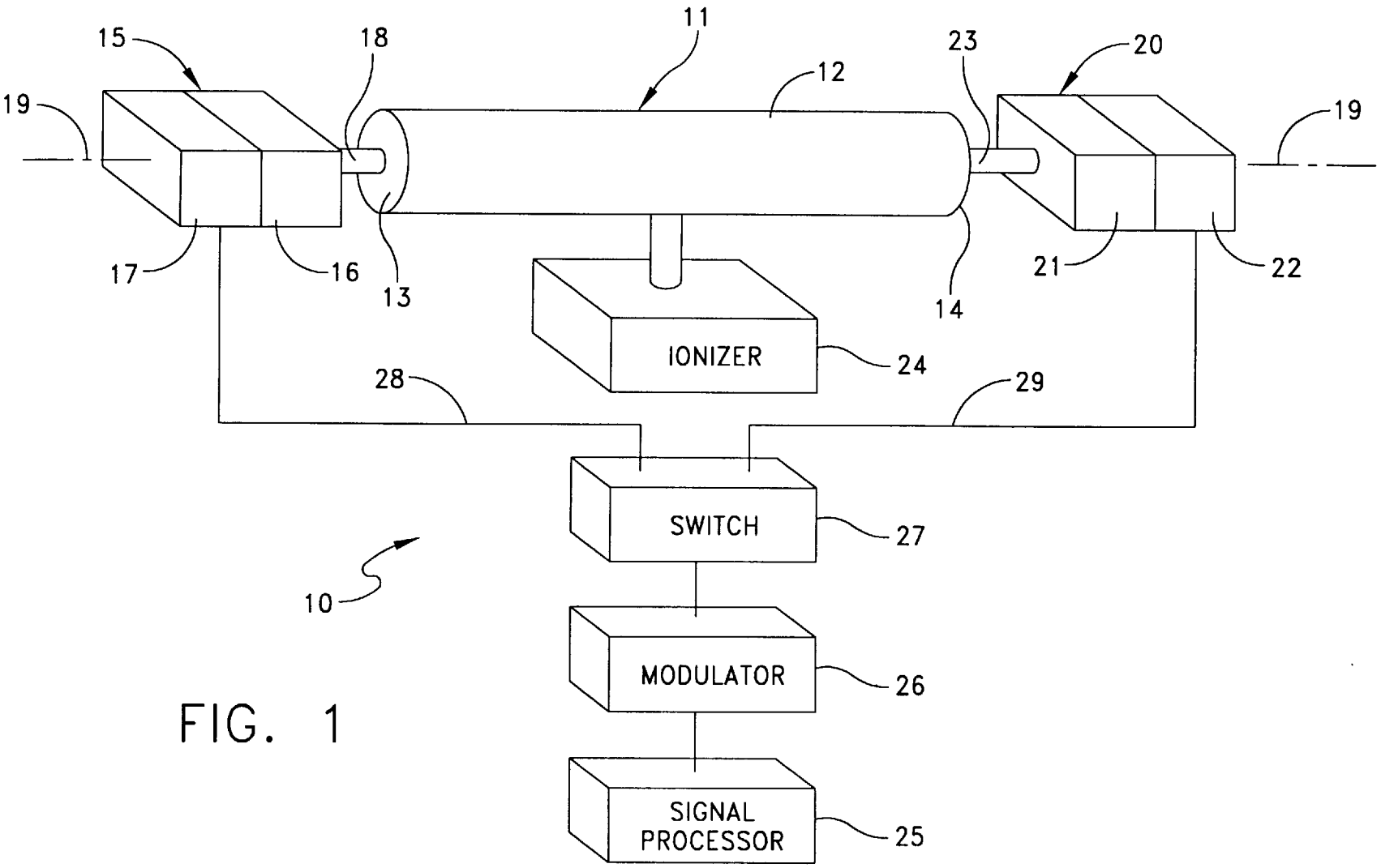
FIG. 1 depicts one embodiment of an antenna system constructed in accordance with this invention.

FIG. 1 schematically depicts a communications transmitter 10 incorporating an antenna system 11 constructed in accordance with one aspect of this invention. In this particular embodiment the antenna system 11 includes a tube 12 having ends 13 and 14. The end 13 connects to a photon generator 15 comprising a laser 16 and laser power supply 17. The laser 16 generates a photon beam conducted through an aperture 18 into the tube 12 along an axis 19 through the tube 12. A second photon beam generator 20, that could include a laser 21 and laser power supply 22, connects at the end 14 of the tube 12 to transmit a laser beam through an aperture 23 into the tube 12 along the axis 19. Consequently the photon generators 15 and 20 are capable of producing oppositely directed coaxial photon beams.

An ionizer 24 also connects to the tube 12. The ionizer 24 can comprise any of a number of different types of ionizers including rf, arc discharge, laser or other ionizing mechanisms. The basic criterion for providing such an antenna is that the plasma in the tube 12 have an electron density of at least $10^{12}$ electrons per cubic centimeter.

Assuming that the natural resonant frequency of the plasma in the tube 12 is close to the desired transmitter frequency, $f_{xmt}$, alternating the operation of the photon generators at $f_{xmt}$ will produce an electron current due to the photons colliding with electrons and transferring momentum from the photon to the electron. Near the natural resonance frequency of the plasma it becomes practicable to reverse the electron travel in the direction of the electron current by changing the direction of the photon beam. That is, if two laser beams are directed through the plasma at a given frequency, but with opposite directions, an alternating electron current will be produced in the plasma.

FIG. 1 depicts a signal processor 25 that produces an output signal to be transmitted. A modulator 26 converts this signal into a bi-stable signal sent to a switch 27 that produces an output on two conductors 28 and 29 in this particular embodiment. When the switch energizes conductor 28, the photon generator 15 is active and the photon generator 20 is inactive. When the switch energizes conductor 29, the photon generator 20 is active, and the photon generator 15 is inactive. In this particular embodiment the switch can energize either the conductor 28 or the conductor 29, but does not energize both of them at the same time.

Figure 2:
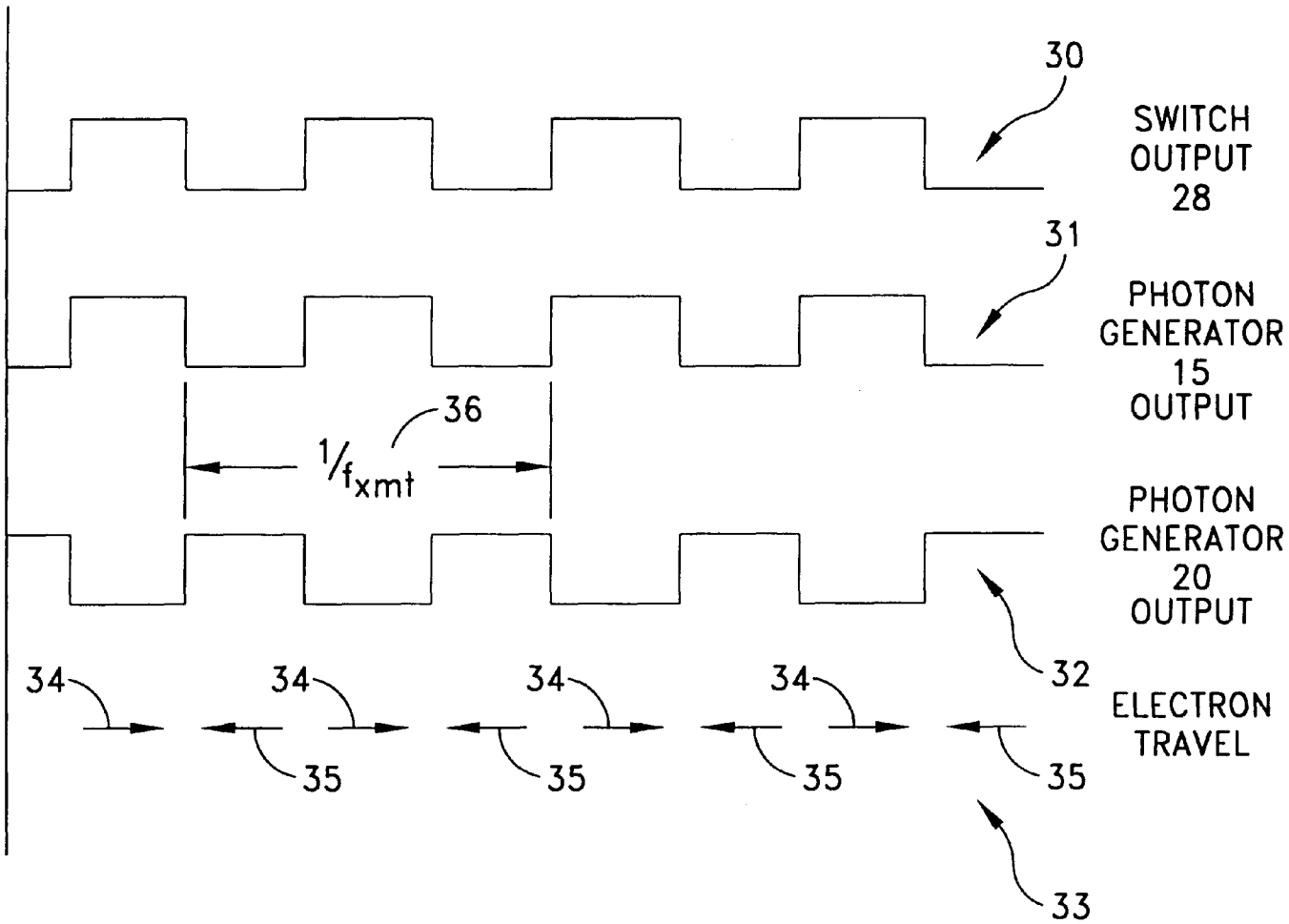
FIG. 2 is a graphical analysis that is helpful in understanding the operation of the antenna system of FIG. 1.

FIG. 2 depicts the switch output on conductor 28 as a pulse train 30. The signal on the conductor 29 is the complement of the pulse train 30. Pulse train 31 represents the output from the photon generator 15, while pulse train 32 represents the corresponding output from the photon generator 20. Graph 33 depicts the direction of electron flow as a series of alternating arrows 34 and 35 representing the electron current. Further as shown at 36, the time interval for an operation of each of the photon generators 15 and 20 corresponds to the interval $1/f_{xmt}$.

As known, plasma contains both ions and electrons. When photons are directed in one direction through the tube 12, they will collide with both electrons and ions. However, the difference in mass between an ion and electron assures that only the collisions with electrons will produce any significant result. Thus, in this particular antenna system transfers of electrons constitute the significant source of the current in the plasma. Any such current introduced by collisions of photons with ions is insignificant.

Figure 3:
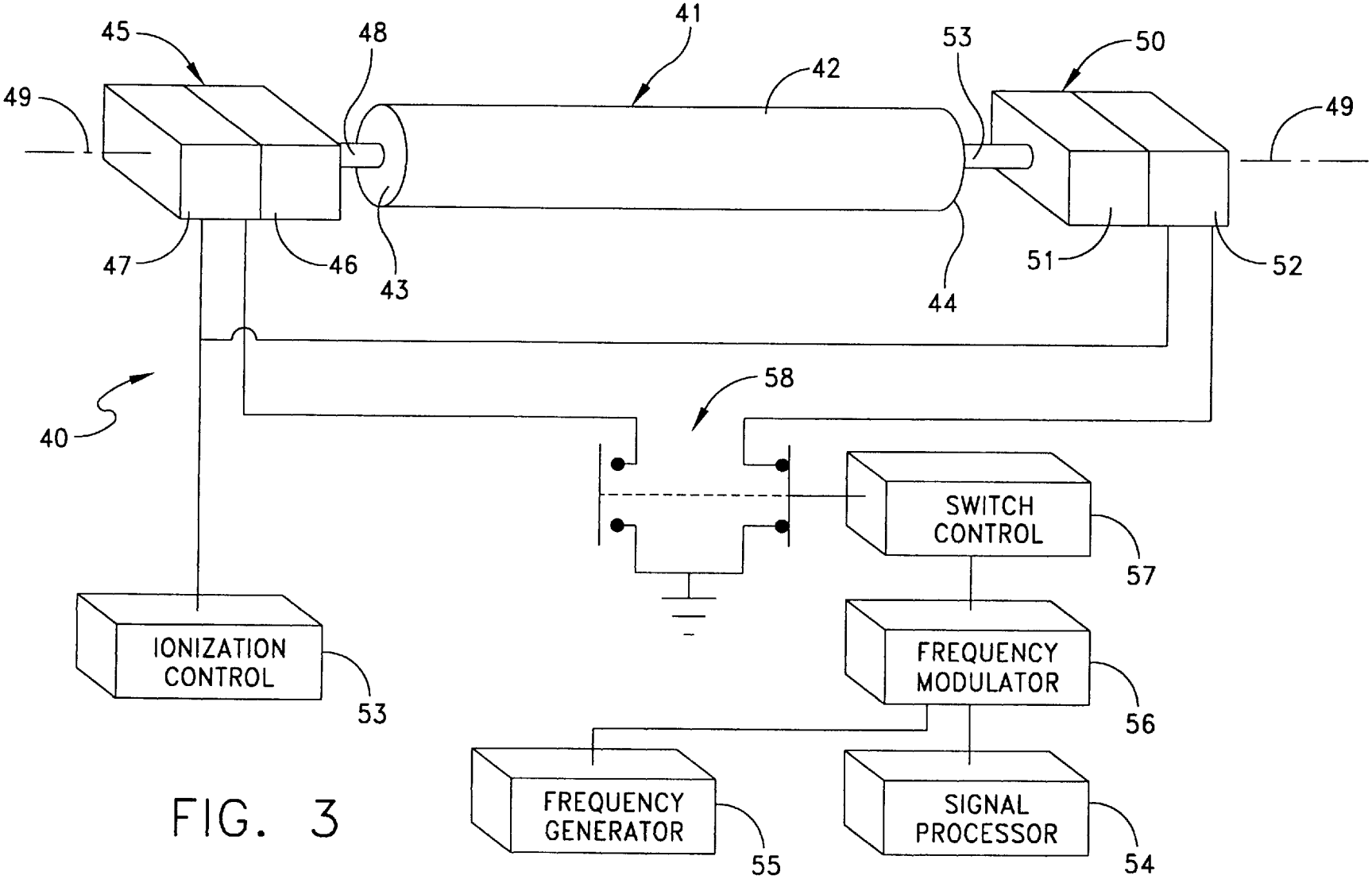
FIG. 3 depicts a second embodiment of an antenna system constructed in accordance with this invention.

FIG. 3 depicts another embodiment in which a photon generator additionally ionizes the gaseous medium and in which a communication system is designed to operate with frequency modulation. As shown in FIG. 3, a communication system 40 includes an antenna system 41 with a tube 42 extending between ends 43 and 44. In this case a combined plasma-photon generator 45 comprises a laser 46 and a laser power supply 47. The laser 46 is positioned to direct an output laser beam through an aperture 48 along an axis 49 through the tube 42 so that the beam from the laser 46 is transmitted from left to right in FIG. 3. At the opposite end a combined plasma-photon generator 50 includes a similar laser 51 and laser power supply 52 that direct a laser beam through an aperture 53 along the axis 49 from right to left in FIG. 3.

As previously indicated, in a preferred operating mode the transmitted frequency, $f_{xmt}$, will be close to the natural plasma resonance frequency. In terms of electron charges, the resonance frequency for the plasma is given by:

$$\omega_p^2 = \frac{4\pi e^2 n_0}{m_e} \tag{1}$$

where $\omega_p$ is equal to the natural resonance plasma frequency in radians per second, e represents the charge on an electron ($1.6\times10^{-19}$ coulombs), $n_o$ is the electron density, and $m_e$ is the mass of an electron (i.e., $1.11\times10^{-31}$ kg). From this equation is clear that the natural resonance frequency varies as the square root of the electron density.

FIG. 3 depicts an ionization control 53 that attaches to each of the laser power supplies 47 and 52 thereby to establish, to the extent permitted by the ability to vary the strength or intensity of the laser beam of a particularly selected laser, the level of ionization within the tube 42. This is shown as a simple open-loop control. It will be apparent appropriate sensors could be used to provide a feedback loop to establish a constant ionization level within the tube 42. In whatever form, the ionization control 53 assures that sufficient ionization exists and that the electron density provides a natural resonance frequency, $\omega_p$, that approximates the operating frequency $f_{xmt}$.

FIG. 3 also depicts a signal processor 54 and a frequency generator 55. A frequency modulator 56 receives the outputs from the signal processor 54 and from the frequency generator 55 that establishes the carrier frequency (i.e., the frequency $f_{xmt}$). The modulator 56 then applies an output signal of varying frequency to a switch control 57. The switch control operates the lasers 46 and 51 through their respective power supplies 47 and 52 to alternate the energization of the laser beams on a mutually exclusive basis.

In this particular embodiment, this control is depicted as a simple switching mechanism 58. When the switch control positions the switch as shown in FIG. 3, the laser 51 is activated; when the switch control reverses its position, the laser 46 is activated.

Although it may be possible to use lasers to provide a constant ionization over each interval, at extremely low frequencies, such continuous wave devices can be prohibitively expensive. Pulse mode lasers offer a better option as ionizers. If the lasers 46 and 51 in FIG. 3 comprise $CO_2$, Nd:YAG or other - lasers, they can operate in a pulsed mode with a pulse repetition frequency that is much higher than ELF. For example, a $CO_2$ laser may operate with a pulse repetition frequency (PRF) in the megahertz range; one such $CO_2$ laser, operates at about 67 MHz with a 33% duty cycle.

Figure 4:
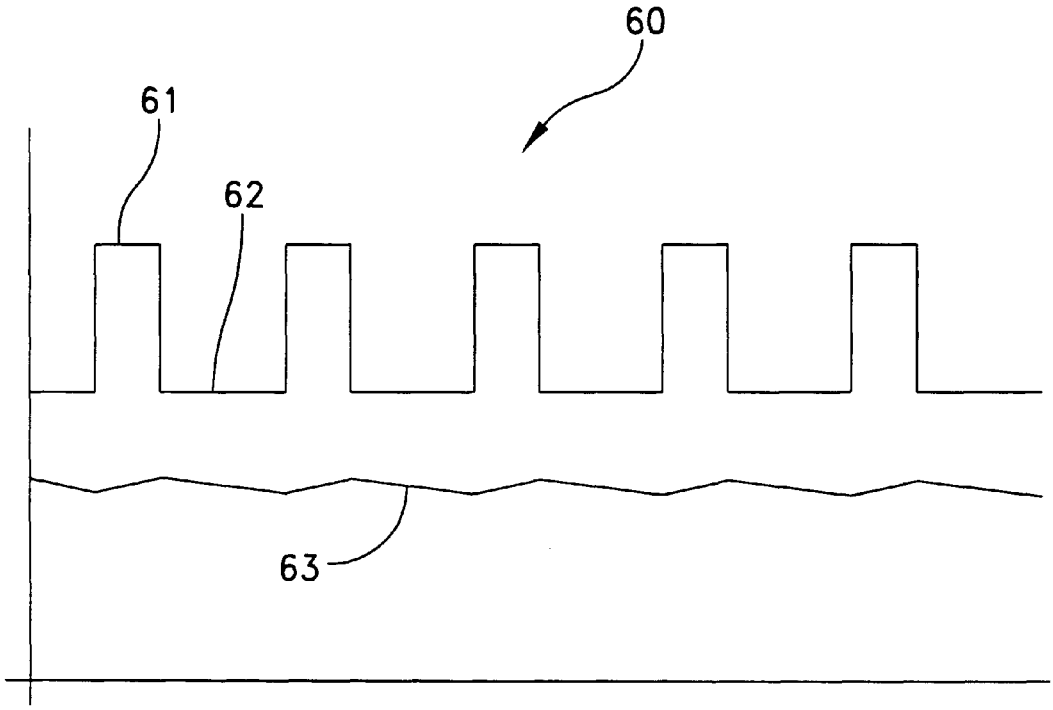
FIGS. 4 and 5 are graphical analyses that are useful in the understanding of the embodiment of the invention shown in FIG. 3.

In FIG. 3, each time the switch 58 energizes a laser power supply, the corresponding laser power generates a pulse train 60 as shown in FIG. 4 that shifts between an ON level 61 and OFF level 62. Each such pulse can be considered to fully ionize the air in a column.

The OFF time 62, between successive pulses in the pulse train 60 is selected to limit the amount of relaxation between successive pulses. For example, the amount of relaxation can be limited to about 10% of the maximum ionization. The OFF time 62 is then selected so that each succeeding pulse at the PRF energizes the respective laser 46, 51 before the ionization relaxes to that reduced level. An ionization graph 63 shows the effect of repetitive pulses having an OFF time corresponding to above criterion. Although there is a minor variation in the ionization level in the column during successive pulses, that variation is less than about 10% of the maximum ionization. Therefore, the variation is insignificant with respect to the operation of this invention.

Figure 5:
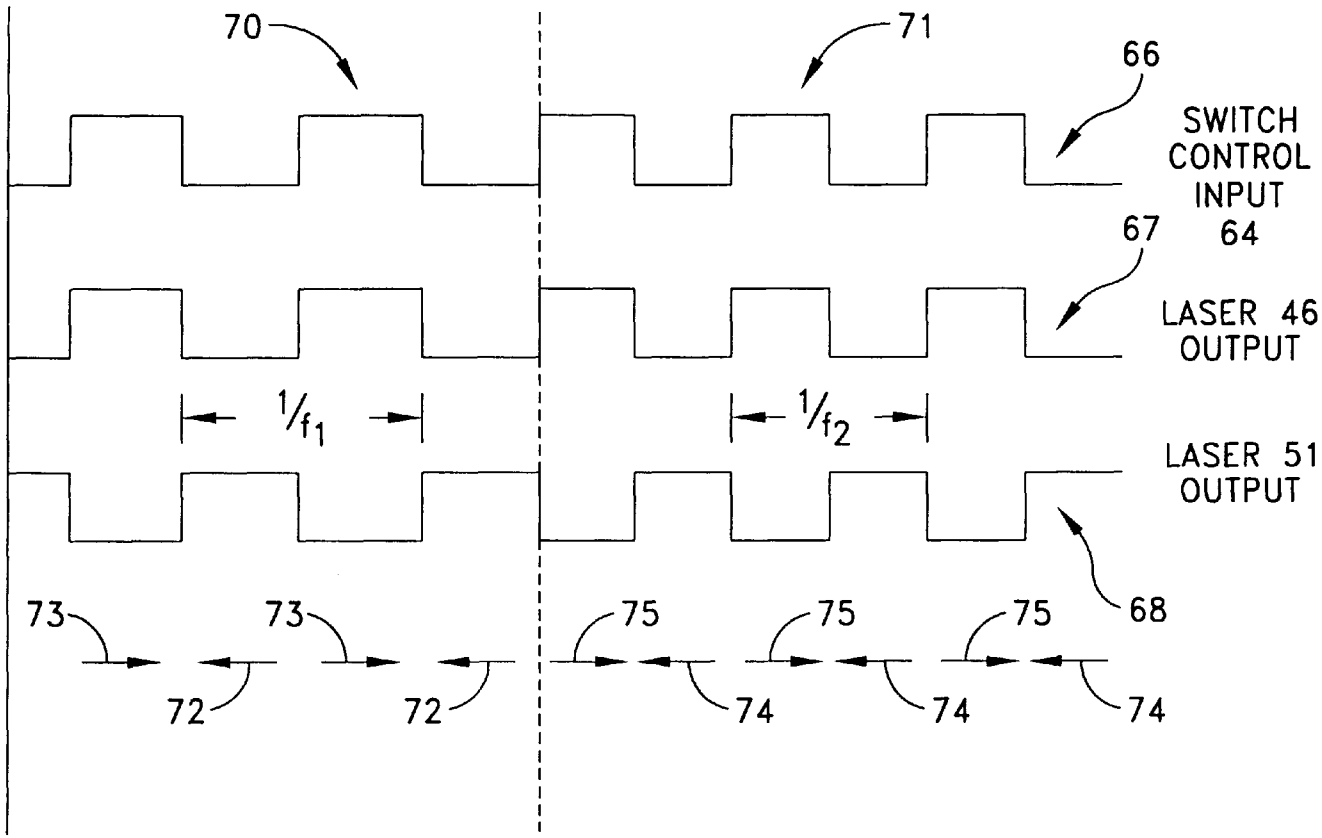

Referring now to FIGS. 3 and 5, graph 66 depicts a control input signal to the switch control 57 for operating the switch 58. Consequently graph 67 then depicts the corresponding output from the laser 46; graph 68, the output from the laser 51.

In this particular embodiment frequency modulation is provided by the modulator 56. FIG. 5 shows two different frequencies. Specifically in an area generally designated by reference numeral 70, the system is operating with $f_{xmt}=f_1$. During this interval the electron currents are represented by vectors 72 and 73. Vectors 73 represent the current when the laser 46 operates; vectors 72, the operation of the laser 51. Similarly vectors 74 and 75 depict the operation of the transmitter 40 in FIG. 3 in section 71 of FIG. 5. In this case $f_{xmt}=f_2$ and, by inspection, $f_2>f_1$.

Further from FIG. 5 it will be apparent that the operation of the circuit in FIG. 3 produces an alternating current due to the interaction of the oppositely directed photon beams from the lasers having a frequency that corresponds to the transmitted frequency. Consequently, the electromagnetic field generated from the antenna system 41 in FIG. 5 will be a frequency-modulated field. It will also be apparent that the embodiment of FIG. 3 is readily adapted to transmitting a phase-modulated carrier by substituting a phase modulator for the frequency modulator 56.

Figure 6:
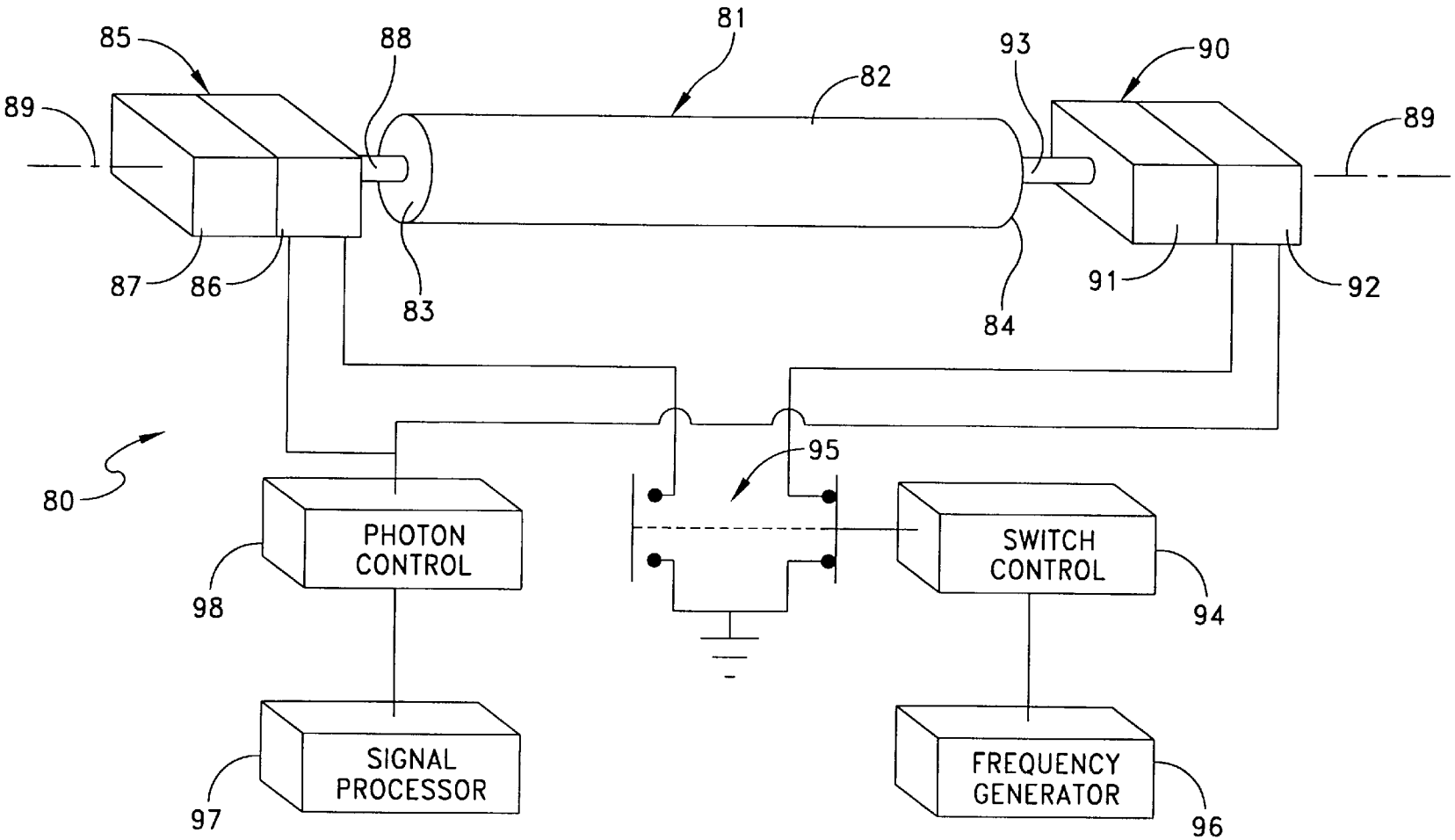
FIG. 6 depicts a third embodiment of an antenna system constructed in accordance with this invention.

FIG. 6 depicts a communication system 80 constructed in accordance with this invention that has a antenna system 81 and that is adapted to operate in an amplitude-modulated mode. The antenna 81 is similar in construction to that shown in FIG. 3. That is, the antenna system 81 includes a tube 82 with ends 83 and 84. End 83 connects to a plasma-photon generator 85 comprising a laser 86 and laser power supply 87. The laser directs a laser beam from an aperture 88 along an axis 89 from left to right in FIG. 6. Another plasma-photon generator 90 includes a laser 91 and laser power supply 92 for directing a laser beam through an aperture 93 along the axis 89 in an opposite direction.

As was true in FIG. 3 a switch control 94 operates a switch 95 to shift the operation of the lasers 86 and 91 on an alternative and mutually exclusive basis. In this particular application, however, the switch responds only to signals from a frequency generator 96 thereby to operate the switch control 94 at a carrier frequency that could be in any frequency range from the ELF range up to the megahertz range.

Amplitude modulation of the signal is provided in response to signals from a signal processor 97 that controls the operation of a photon control circuit 98 that, in turn, controls the level of ionization produced by the lasers 86 and 91. By controlling this level, the number of photons in the laser beam and hence the magnitude of the electron current will vary as a function of laser beam strength. So long as the electron density, no, does not vary significantly, the system continues to operate effectively because there is a finite bandwidth associated with the plasma natural resonance frequency, $\omega_p$.

Figure 7:
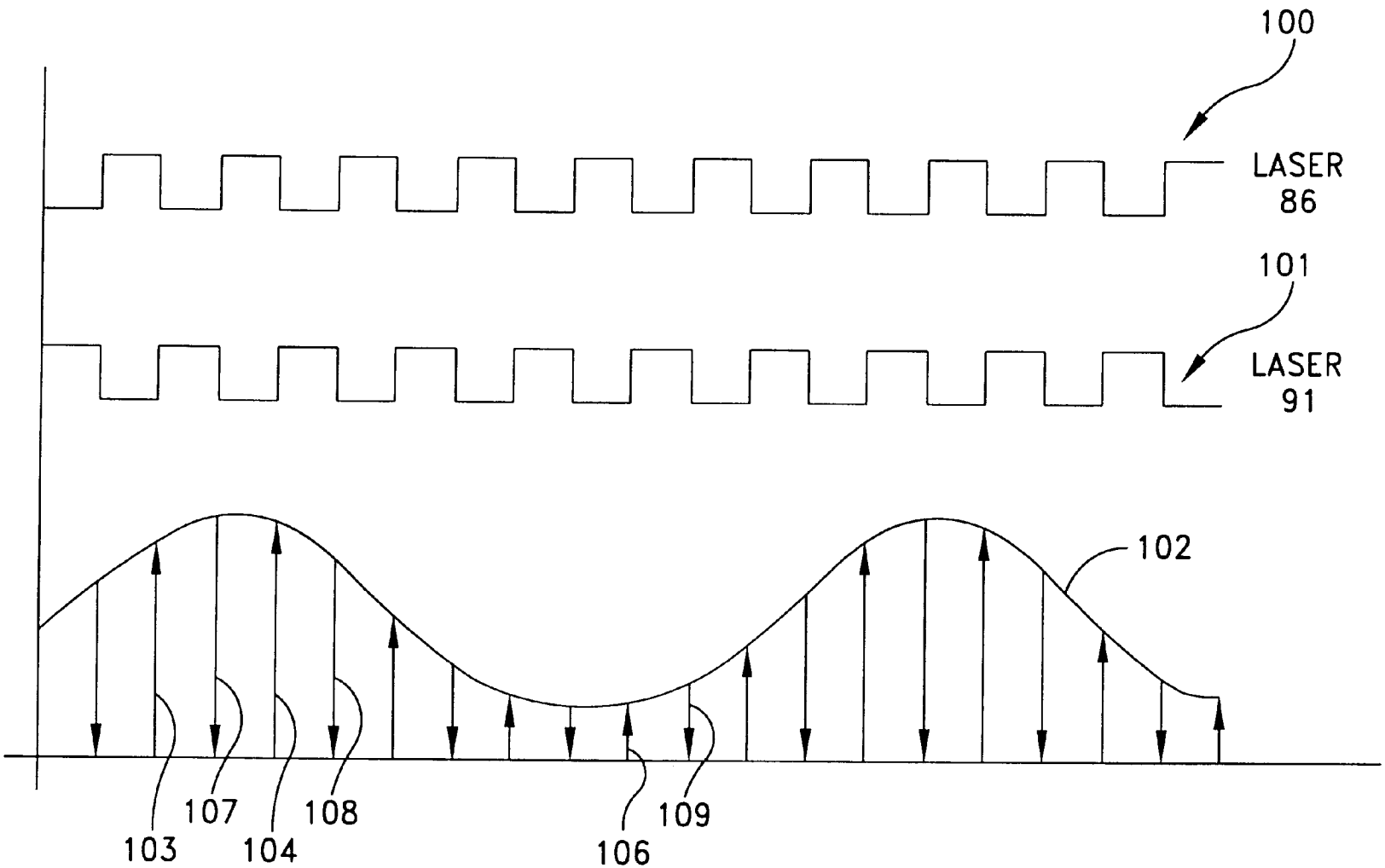
FIG. 7 is a graphical analysis useful in the understanding of an operation of the embodiment of the invention of FIG. 6.

FIG. 7 depicts the output switching frequency for the lasers 86 and 91. Specifically graph 100 shows the ON and OFF times for the laser 86; graph 101 the alternating and mutually exclusive ON and OFF times for the laser 91. Graph 102 represents the signal applied to the photon control 98 thereby to establish a corresponding variation in the energization level for the laser beam produced by each of the lasers 86 and 91. As a result the direction of the electron currents will vary as previously indicated.

In FIG. 7 arrows 103, 104 and 106 are representative of electron current vectors generated when the laser 86 is active. Arrows 107, 108 and 109 represent the electron current vectors produced when the laser 91 is active. While the frequency with which the electron vectors are generated is constant, the magnitude varies so that the resulting electromagnetic radiation from the antenna assembly 81 is an amplitude-modulated, constant-frequency signal.

Although the foregoing description has been in terms of a solution for communications in the ELF range, the general principles of this invention are equally applicable to signals in the kHz and MHz ranges. Each such antenna has disclosed in the foregoing figures as including a tube extended along an axis that contains a plasma. Lasers or other photon generators are positioned at opposite ends of the plasma column for directing photon beams along the axis in opposite directions. By generating photon beams in an alternate fashion, photons transfer momentum to the electrons in the plasma and the alternating nature of this operation produces an alternating electron base current that radiates as an alternating electromagnetic field from the antenna.

This invention has been described in terms of specific implementations. Different lasers or ionization sources, different laser power supply operations and different signal processor operations can all be incorporated in a plasma antenna that relies upon the different diffusion and relaxation rates for ions and electrons in the plasma. Moreover, optical systems could be substituted directing a laser beam from a signal laser to opposite ends of a tube in any of the patterns described above. Therefore, it is the intent of the appended claims to cover all such variations and modifications as come within the true spirit and scope of this invention.

What is claimed is:

1. An antenna for radiating an electromagnetic field at a predetermined frequency comprising:

plasma means extending along an axis for containing a plasma;

first and second photon generation means located at each end of said plasma means for directing first and second photon beams, respectively, along the axis through the plasma in opposite directions; and means for energizing said first and second photon generation means alternately thereby to generate in the plasma an alternating current that produces the radiated electromagnetic field at the predetermined frequency.

2. An antenna as recited in claim 1 wherein said plasma means includes:

a tube for containing a gas taken from the group consisting of air and the inert gases; and means connected to said tube for ionizing the gas to produce the plasma.

3. An antenna as recited in claim 2 wherein said each of said photon generating means comprises a laser and power supply, said energization means driving said lasers and power supplies alternately.

4. An antenna as recited in claim 3 additionally comprising means for maintaining a plasma in said plasma means with a concentration of at least $10^{12}$ electrons per cubic centimeter.

5. An antenna as recited in claim 3 wherein said energization means includes modulation means for controlling the rate at which said first and second lasers direct their respective first and second laser beams through the plasma.

6. An antenna as recited in claim 5 wherein said modulation means includes:

a carrier frequency generator;

a signal processor for generating a frequency modulation control signal; and means for frequency modulating the rate at which said first and second lasers direct their respective first and second laser beams through the plasma.

7. An antenna as recited in claim 5 wherein said modulation means includes:

a carrier frequency generator;

a signal processor for generating a phase modulation control signal; and means for phase modulating the rate at which which said first and second lasers direct their respective first and second laser beams through the plasma.

8. An antenna system as recited in claim 5 additionally comprising:

means for controlling the ionization level in the plasma thereby to control the electron density in the plasma;

means for generating a fixed carrier frequency for controlling the rate at which which said first and second lasers direct their respective first and second laser beams through the plasma; and means for generating an amplitude modulation signal, said ionization level controlling means being responsive to the amplitude modulation signal for changing the magnitude of the electron current whereby for the antenna radiates an amplitude-modulated electromagnetic field.

9. An antenna as recited in claim 2 wherein said each of said photon generating means comprises a laser and power supply, said energization means driving said lasers and power supplies in a mutually exclusive fashion.

10. An antenna as recited in claim 9 additionally comprising means for controlling a density of the plasma in said plasma means.

11. An antenna as recited in claim 1 wherein said energization means additionally includes:

signal processing means for generating a signal to be transmitted; and modulator means connected to said signal processing means for controlling the energization of said first and second photon generating means.

12. An antenna as recited in claim 11 wherein said modulator means includes a frequency modulator for enabling the transmission of frequency modulated signals by varying the frequency at which the first and second photon generation means are alternately energized.

13. An antenna as recited in claim 11 additionally comprising:

means connected to said plasma means for controlling the ionization level of the plasma;

an amplitude modulator in said energization means for controlling the ionization level of said plasma as a function of time; and a carrier frequency generator for controlling the frequency at which said first and second photon generating means are alternately energized.

14. An antenna as recited in claim 11 wherein said modulator means includes a phase modulator for enabling the transmission of phase modulated signals by varying the phase of the frequency at which the first and second photon generation means are alternately energized.

15. An antenna as recited in claim 1 additionally comprising means connected to said plasma means for controlling the ionization level of the plasma.

16. A method for radiating an electromagnetic field at a predetermined frequency comprising:

producing an elongated plasma extending along an axis;

directing first and second photon beams, respectively, along the axis through the plasma in opposite directions; and energizing the first and second photon beams in an alternative fashion thereby to generate in the plasma an alternating current that produces the radiated electromagnetic field at the predetermined frequency.

17. A method as recited in claim 16 wherein said plasma producing step includes:

containing a gas taken from the group consisting of air and the inert gases in an elongated tube; and ionizing the gas in the tube to produce the plasma.

18. A method as recited in claim 17 wherein said energization of the photon beams includes the step of energizing a laser and power supply thereby to produce first and second oppositely directed laser beams as the first and second photon beams.

19. A method as recited in claim 18 including the step of maintaining the plasma in the plasma container at a concentration of at least $10^{12}$ electrons per cubic centimeter.

20. A method as recited in claim 18 wherein said energization step includes controlling the rate at which said first and second laser beams are directed through the plasma.

21. A method as recited in claim 20 wherein said step of rate controlling includes the steps of:

generating a carrier frequency generator;

generating a frequency modulation control signal in response to the carrier frequency and a signal to be transmitted; and frequency modulating the rate at which the first and second laser beams are directed through the plasma.

22. A method as recited in claim 20 wherein said step of rate controlling includes the steps of:

generating carrier frequency;

generating a phase modulation control signal in response to the carrier frequency and a signal to be transmitted; and phase modulating the rate at which the first and second laser beams are directed through the plasma.

23. A method as recited in claim 20 additionally comprising:

generating a fixed carrier frequency for controlling the rate at which which said first and second lasers direct their respective first and second laser beams through the plasma;

generating an amplitude modulation signal in response to a signal to be transmitted; and controlling the ionization level in the plasma thereby to vary the electron density in the plasma whereby the magnitude of the electron current varies as the amplitude modulating signal and an amplitude-modulated electromagnetic field radiates from the plasma.

24. A method as recited in claim 16 wherein said energization of the photon beams includes the step of energizing a laser and power supply thereby to produce first and second oppositely directed and alternatively and mutually exclusively energized first and second photon beams.

25. A method as recited in claim 24 additionally comprising the step of controlling the density of the plasma.

26. A method as recited in claim 16 wherein said energization step additionally includes the steps of:

generating a signal to be transmitted; and controlling the energization of said first and second photon generating means in response to the signal.

27. A method as recited in claim 26 wherein said energization control step includes modulating the frequency at which the first and second photon beams are alternately energized.

28. A method as recited in claim 26 wherein said energization control step includes:

generating a carrier frequency for controlling the frequency at which the first and second photon beams alternate;

generating a modulating signal; and controlling the ionization level of the plasma in response to the modulating signal.

29. A method as recited in claim 26 wherein said energization control step includes phase modulating the phase of the frequency at which the first and second photon generation means are alternately energized.

30. A method as recited in claim 16 additionally comprising the step of controlling the ionization level of the plasma.

* * * * *